United States Patent [19]

Bijlmer

[11] 4,042,475

[45] Aug. 16, 1977

[54] PICKLING OF ALUMINUM

[75] Inventor: Paul Frederik A. Bijlmer, Nieuw-Vennep, Netherlands

[73] Assignee: Fokker-VFW B.V., Schiphol, Netherlands

[21] Appl. No.: 674,445

[22] Filed: Apr. 7, 1976

[30] Foreign Application Priority Data

Apr. 9, 1975 Netherlands ..... 7504244

[51] Int. Cl.[2] ..... C25F 1/00; C25F 1/04; C25F 7/00

[52] U.S. Cl. ..... 204/141.5; 204/231

[58] Field of Search ..... 204/231, 141.5, 145, 204/33, 129.1, 129.2, 129.25

[56] References Cited

U.S. PATENT DOCUMENTS

| | | | |
|---|---|---|---|
| 2,040,618 | 5/1936 | Mason | 204/141.5 |
| 3,694,334 | 9/1972 | Bombara | 204/145 |

*Primary Examiner*—T. M. Tufariello

*Attorney, Agent, or Firm*—Snyder, Brown & Ramik

[57] ABSTRACT

Articles of aluminium or aluminium alloys are pickled by placing them as anodes into a sulfuric acid bath containing no chromic acid or bichromate and connecting them by an electrical circuit including a D.C. potential source to a suitable cathode placed in the same bath, then imposing a certain control voltage from the potential source onto the anode and maintaining the resulting anode voltage at a substantially constant level during the whole pickling period. Means may be provided for continuously measuring the anode voltage and readjusting it to keep the voltage constant.

8 Claims, 1 Drawing Figure

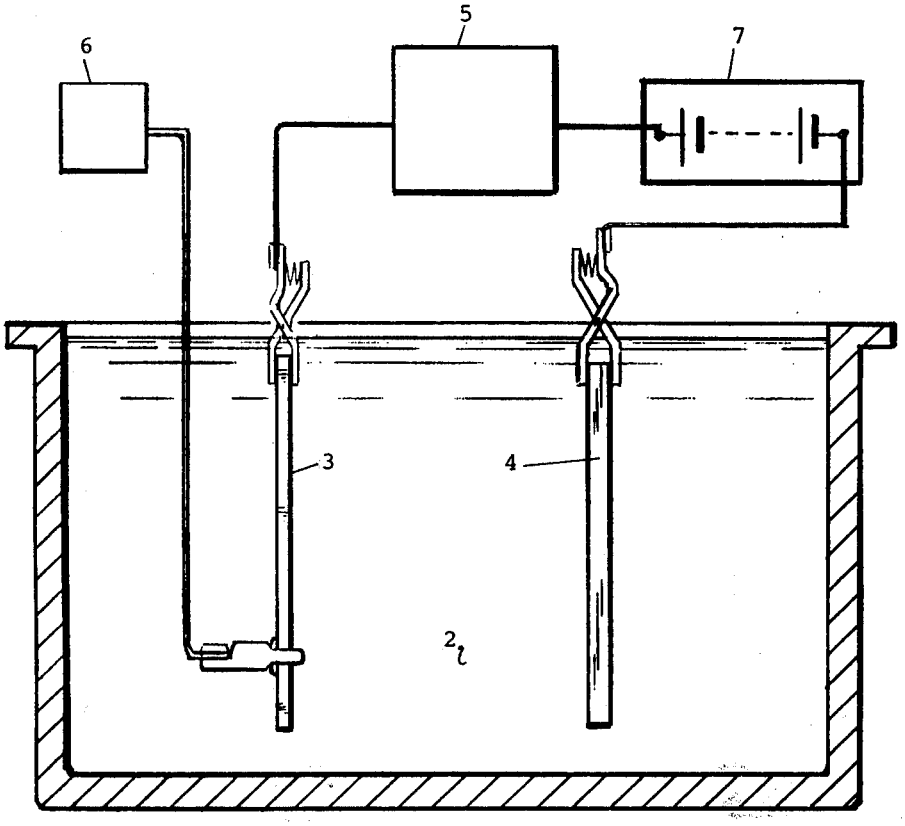
5
6
7
3
4
2

PICKLING OF ALUMINUM

BACKGROUND OF THE INVENTION

This invention relates in general to the pickling of aluminium and more in particular to a new process for pickling aluminium and aluminium alloy articles.

Articles of aluminium and aluminium alloys are often pickled at their surfaces in order to remove undesired oxide layers. This pickling operation may serve to obtain a more attractive appearance but also to give the pickled surface better adhesive properties for making glued joints or welded joints or to prepare it for an anodizing treatment.

The pickling operation is usually carried out by immersion of the article to be pickled into an acid bath which comprises an oxidation agent in addition to a strong acid. Baths of chromic acid and sulfuric acid, as well as baths of sodium bichromate and sulfuric acid have been found to be most suitable for this purpose. However, although excellent results may be achieved in this way, the use of such pickling baths has become more and more objectionable in these days in view of the fact that the exhausted baths, due to their chromic acid or bichromate content, are most harmful to the environment and may, therefore, not be discharged to a sewer or to surface water in a direct way.

During a search for alternative pickling methods, I have now found that the same good results as in the past may be achieved with a pickling bath of sulfuric acid alone, provided that a slight anodic control voltage is applied onto the bath. The invention has for its object to provide a pickling process for aluminium articles wherein the pickling bath as used does not contain any chromic acid or bichromate.

A further object is to provide a pickling process for aluminium articles whereby pickled articles of excellent quality can be obtained without the use of chromic acid or bichromate in the pickling bath.

A still further object is to provide apparatus for effecting the pickling of aluminium articles without any use of chromic acid or bichromate in the pickling bath.

In accordance with the invention, these objects are fulfilled by providing a pickling bath containing sulfuric acid without any chromic acid or bichromate oxidation agent. An aluminium article to be pickled is positioned as an anode into this pickling bath together with a suitable cathode, whereupon the anode and cathode are interconnected by an electrical circuit which includes a D.C. potential source. The resulting equilibrium voltage between the anode and the pickling bath is measured by means of a saturated calomel electrode. Then, a control voltage derived from the D.C. potential source and being at most some hundreds of millivolts in excess of the equilibrium voltage is imposed onto the anode in order to start the pickling operation. The resulting anode voltage is continuously measured and maintained substantially constant by re-adjusting the control voltage where necessary. These steps are continued during a time period sufficient to reach a completely pickled aluminium surface whereupon the electrical means are disconnected and the pickled article is recovered in the usual way.

By proceeding in this manner, it is possible to obtain equal or better results as compared with using baths of chromic acid-sulfuric acid or bichromate-sulfuric acid. The great advantage is that chromic acid or bichromate are no longer required and this means that problems inherent to the disposal of exhausted baths are notably reduced.

BRIEF DESCRIPTION OF THE DRAWINGS

The single FIGURE of the drawings shows schematically a preferred embodiment of an apparatus for carrying out the invented process.

DESCRIPTION OF THE PREFERRED EMBODIMENT

A relatively simple apparatus may be used for carrying out the invented process and a preferred embodiment thereof is shown in the single FIGURE of the drawing. This FIGURE shows a pickling tank 1 containing a pickling bath 2 of sulfuric acid (without chromic acid or bichromate). Two electrodes, viz. an anode 3 and a cathode 4, have been immersed into bath 2, the anode 3 being an aluminium article to be pickled by the invented process and the cathode 4 being an electrode of any suitable material such as stainless steel or lead or the like. It should be understood here in this description that the term "aluminium" will include more or less pure aluminium metals as well as aluminium alloys of different compositions. D.C. potential source 5 is connected to both electrodes for supplying an anodic control voltage to be imposed upon the bath. Furthermore, anode 3 is coupled to a saturated calomel electrode 6 for continuous measuring of the anode voltage. A potentiometric control device 7 responding to the voltage value as measured in the calomel electrode 6 is connected to the D.C. potential source 5 so as to continuously maintain the anode voltage at a constant level.

After placing electrodes 3 and 4 into the pickling bath 2, an equilibrium voltage between anode and bath is measured by means of calomel electrode 6. Then, a control voltage derived from potential source 5 is applied to the anode by means of control device 7, this control voltage being at most some hundreds of millivolts in excess over said equilibrium voltage. The resulting voltage once achieved is maintained constant then during the whole period of time required for pickling. In the course of the pickling process, the actual anode voltage will tend to vary regularly, due to removal of an oxide layer initially present at the anode surface and due to consumption of sulfuric acid from the bath by metallic aluminium which dissolves into that bath. Therefore, it is preferred to measure the anode voltage continuously by means of said calomel electrode 6 and to adjust the applied control voltage (where needed) by means of said control device 7 in order to maintain the anode voltage at a constant level. In this manner, the pickling process is controlled very well.

The results of the pickling process may be expressed in various ways, e.g., by stating pickling rate and peel strength values. The pickling rate is an indication for the thickness of an oxide layer removed in the course of the pickling process and is expressed in $mg.dm^{-2}.h^{-1}$. The peel strength relates to a test wherein an adhesive layer is attached to the pickled surface and then peeled off. In the following tests, a phenolic resin of the type Redux 775 of Ciba (Registered Trademark) was used as an adhesive for peel strength determination.

The results of the pickling process may also be expressed by stating microstructure quality of the aluminium surface. Such microstructure may be ascertained by electron-microscopic inspection of direct carbon replicas taken directly from the aluminium surface. Generally speaking, a surface of aluminium is only suitable for making adhesive joints if the microstructure of this surface shows microscopic pits of about 200 $\mu$ in diameter. Should the pickling rate be too small, then residual oxide particles will still be present, and should the anode voltage be too low (about equal to the equilibrium voltage), then only a smooth surface is obtained. The combination of a pickling rate which is too small and an anode voltage which is too low will give rise to filamentary effects below a residual layer on the aluminium surface.

The question whether the pickling process follows a good course and whether good results are obtained thereby, will further be dependent from various conditions, like e.g.: the sulfuric acid concentration in the pickling bath, the bath temperature, the treatment time, and the value of the anode voltage.

A series of tests was made in order to define suitable reaction conditions for a pickling process, when used as a pre-treatment for making glued joints. In these tests, articles of "Alclad" 2024-T3 (Registered Trademark) were used, i.e. an aluminium-copper alloy coated with a layer of aluminium. One of the four conditions was varied each time, the other factors being kept then at a fixed optimal value. The concentration of sulfuric acid was varied between 100 and 300 grams per liter, the bath temperature was varied between 40° and 60° C, the anode voltage was varied between the equilibrium voltage and +200mV, and the treatment time was varied between 10 and 30 minutes. The results are indicated in the following table, wherein E.P. is the equilibrium voltage and SCE is a saturated calomel electrode.

TABLE

| | | | | |
|---|---|---|---|---|
| $H_2SO_4$ concentration, g/l | 100 | 200 | 300 | |
| Pickling rate, % of optimum | 57 | 80 | 100 | |
| Peel strength, % of optimum | 100 | 99 | 99 | |
| Bath temperature, ° C | 40 | 50 | 60 | |
| Pickling rate, % of optimum | 25 | 58 | 100 | |
| Peel strength, % of optimum | 95 | 100 | 74 | |
| Anode voltage, mV versus SCE | −600 (E.P.) | −200 | 0 | +200 |
| Pickling rate, % of optimum | 18 | 68 | 83 | 100 |
| Peel strength, % of optimum | 13 | 55 | 90 | 100 |
| Treatment time, min. | 10 | 30 | | |
| Pickling rate, % of optimum | 96 | 81 | | |
| Peel strength, % of optimum | 100 | 100 | | |

It is evident from the Table that the optimum pickling conditions when used as a pre-treatment for making glued joints are as follows:

a sulfuric acid concentration of 100 to 300 g/l
a bath temperature of 50° to 60° C
an anode voltage of from −100 to +200 mV, and
a treatment time of 10 to 30 minutes.

The results obtained under these optimum conditions are equivalent to those obtained with a bath of chromic acid-sulfuric acid or sodium bichromate-sulfuric acid under the following conditions:

$H_2SO_4$ concentration, 200 to 300 g/l
chromic acid/bichromate concentration, 40 to 60 g/l
bath temperature 60 to 70° C
treatment time 10 to 30 minutes.

The bath of sulfuric acid may be used several times for pickling aluminium articles but the $H_2SO_4$ concentration therein, as well as the bath temperature and the initial anode voltage should preferably be measured each time at the onset of a new run in order to be able to make adjustments where necessary.

A small proportion of aluminium will always dissolve into the pickling bath during a pickling process and therefore, the aluminium concentration in the bath should be measured regularly as well. Further, the current density may be measured periodically by using a control sample of known dimensions as an anode. In general, the sulfuric acid bath will become unsuitable for further use at an aluminium content of about 20 g/l. It is then neutralised, e.g. with lime or calcium hydroxide or caustic soda, and may thereafter be discarded. In view of the fact that the exhausted bath does not contain chromic acid or sodium bichromate, its disposal is easier than with exhausted baths of the prior art.

What I claim is:

1. The method of pickling aluminum articles which comprises the steps of:

a. providing a pickling bath containing sulfuric acid without any chromic acid or bichromate oxidizing agent;
b. positioning the aluminum article in the bath of step (a) and measuring the potential between said article and the bath;
c. imposing a control voltage between said article and a cathode positioned in said bath in spaced relation to the article, said control voltage having a value at least sufficient to raise the potential of said article near to zero volts but said control voltage having a value less than 1 volt;
d. maintaining said control voltage substantially constant for a time sufficient to produce microscopic pits of about 200$\mu$ in diameter in the surface of said article; and then
e. recovering said article from the bath.

2. The method as defined in claim 1 wherein the control voltage imposed in step (c) establishes the potential of the article at a value of from −100 to +200mV.

3. The method as defined in claim 2 wherein the bath of step (a) contains sulfuric acid in concentration of 100–300 grams per liter.

4. The method as defined in claim 3 wherein the bath of step (a) is maintained at a temperature of 50°–60° C.

5. The method as defined in claim 4 wherein the time of step (d) is 10–30 minutes.

6. The process as claimed in claim 1, wherein said article is an aluminium alloy article.

7. The process as claimed in claim 1, wherein said article is an article of aluminium-copper alloy coated with a layer of aluminium.

8. The process as claimed in claim 1, wherein step d) is effected by continuously measuring the resulting voltage between said anode and said pickling bath and readjusting said voltage where necessary by means of said control voltage.

* * * * *